United States Patent [19]

Rausing

[11] Patent Number: 4,541,463

[45] Date of Patent: Sep. 17, 1985

[54] FILLER ON PACKING MACHINES

[75] Inventor: Hans A. Rausing, Wadhurst Park, England

[73] Assignee: Tetra Pak International AB, Lund, Sweden

[21] Appl. No.: 522,805

[22] Filed: Aug. 12, 1983

[30] Foreign Application Priority Data

Aug. 17, 1982 [SE] Sweden ..... 8204730

[51] Int. Cl.[4] ..... B67C 3/02

[52] U.S. Cl. ..... 141/147; 141/145; 141/264; 222/168

[58] Field of Search ..... 141/144, 145, 146, 147, 141/148, 150, 237, 242, 243, 264; 222/168, 168.5, 330

[56] References Cited

U.S. PATENT DOCUMENTS 921,032 5/1909 Webster et al. ..... 141/147 X 2,144,628 1/1939 Hothersall ..... 141/147 X

*Primary Examiner*—Charles E. Phillips

*Assistant Examiner*—Mark Thronson

*Attorney, Agent, or Firm*—Burns, Doane, Swecker & Mathis

[57] ABSTRACT

The invention relates to a filler for metering liquid products, into containers. The filler includes a vessel which is provided with a number of filling pipes communicating with the inside of the vessel and projecting from the bottom of the vessel, and which is provided with a feed pipe both ends of which open inside the vessel. In the feed pipe a pump is arranged which pumps product from the vessel to the outlet opening of the feed pipe which can be joined successively with the filling pipes as a function of the rotation of the vessel.

16 Claims, 10 Drawing Figures

52
50

III
51
53
54
58
55
56
57
66
60
59
61
67
65
62
64
68
63

52
50
51

IV
53
54
58
55
56
57
66
60
59
61
62
67
65
64
68
63

FILLER ON PACKING MACHINES

BACKGROUND AND SUMMARY OF THE INVENTION

The present invention relates to a filler for packing machines of a type where a liquid product is metered into packing containers.

Modern packing machines for the packaging of liquid products, such as milk, fruit juices etc. in non-returnable packages of paper and plastics have a very high production capacity, and a rate of manufacture of 8000–10,000 packages per hour in a packaging line is not uncommon. The rate of packaging naturally depends to some extent on the size of the packages and it has been found that especially the so-called filling of liquid product by metering is a limiting factor for the capacity of packaging machines of the aforementioned type. Given the high rates of manufacture of packages as indicated above, the filling has to take place in an extremely short time, mostly fractions of a second, which makes great demands on the filling arrangements, and in particular the demand on volume accuracy of the packages is very high. One precondition for making it possible to achieve a filling in the short times which are available is that the filling should take place with little or no turbulence, without spill, splashing over and without formation of froth, that is without allowing air to interfere in the filling.

It is known that in packing machines of the aforementioned type, so-called piston fillers are used. That is to say cylinders are connected to the filling pipe wherein movable pistons are arranged by which the product is pressed out through the filling pipe and down into the packages. These piston fillers in many cases work satisfactorily, but they are relatively expensive and bulky and also relatively awkward to clean. Moreover, if piston fillers are used in e.g. a rotating filling machine with a number of filling pipes, a piston filler has to be assigned to each filling pipe, which as mentioned before will be expensive and bulky, especially since as a rule driving mechanisms for the piston fillers have to be provided at the rate of one mechanism for each piston filler.

A need exists, therefore, for a filler of a different kind and such a filler is described in the following and has the characteristics which are evident from the subsequent description.

BRIEF DESCRIPTION OF THE DRAWINGS

A preferred embodiment of the invention will be described in the following with reference to the enclosed schematic drawings wherein like elements bear like reference numerals, and wherein.

DETAILED DESCRIPTION OF A PREFERRED EMBODIMENT

Figure 1:
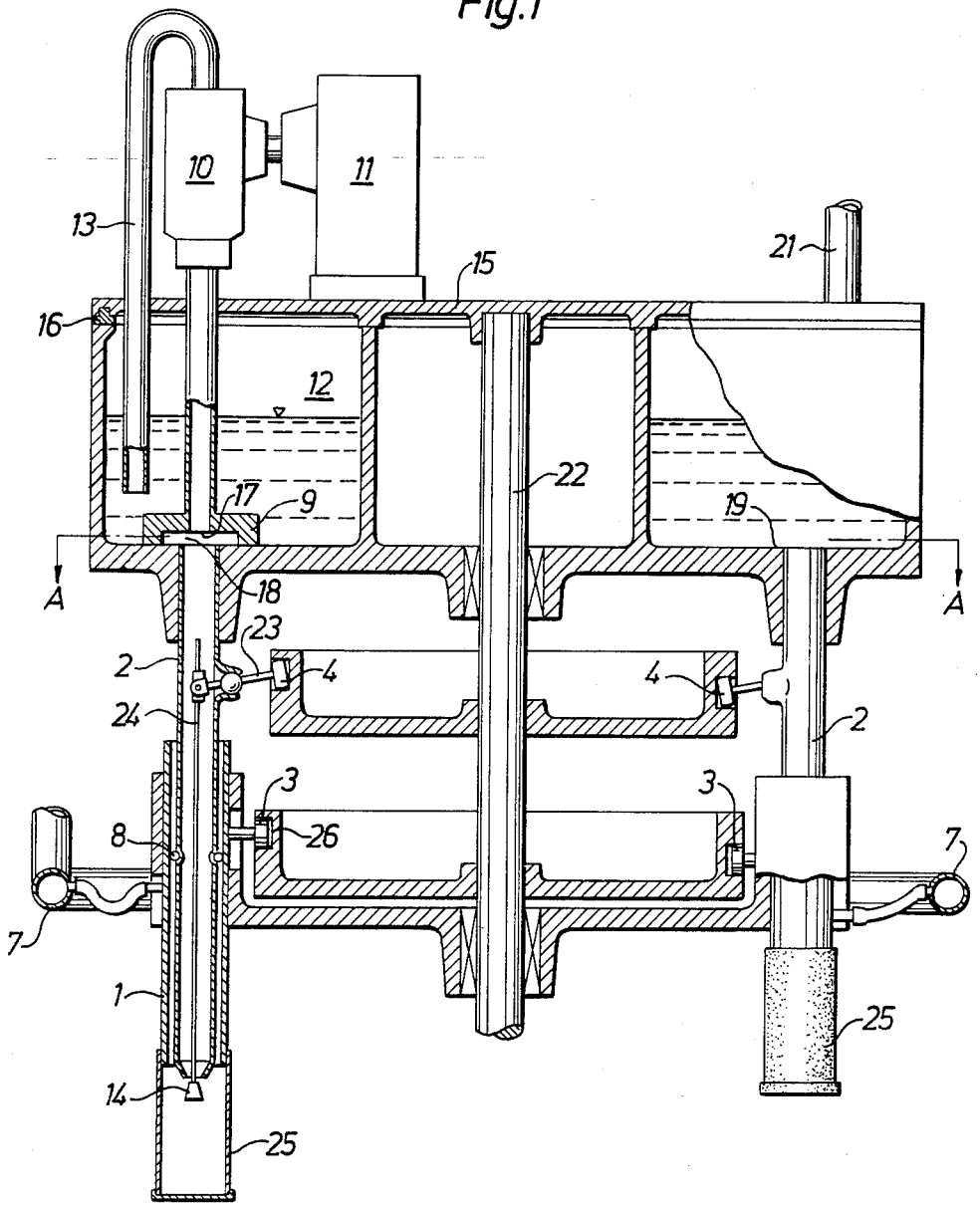
FIG. 1 is a schematic cross-section through a filler in accordance with the invention.

With reference to FIG. 1, a vessel 12 is shown for the liquid, for example milk, which is to be filled. The vessel 12 can be rotated about an axle 22 and is provided with a stationary lid 15 which has a sliding seal 16 against the upper edge of the vessel 12. Through the lid 15 may pass a supply line 21 for the product (liquid), and in the vessel 12 a float or level-monitoring electrodes may be arranged in a manner not shown here, so as to obtain a substantially constant liquid level. In the rotating vessel 12 are arranged a number of filling pipes 2 communicating with the inside of the vessel 12. The filling pipes 2 are fixed at the bottom of the vessel and run vertically downwards from the same, each pipe 2 ending fixed at the bottom of the vessel 12 with the top sides of the pipes being ground even. In each pipe 2, moreover, a mechanically controlled valve 14 is provided in its lower part, which will be described in detail herein. A preferably stationary feed pipe 13, designed as a siphon, is provided, the two ends of which open inside the vessel 12 below its liquid level and one end of which 17 can be joined successively with regard to the flow to each of the filling pipes 2 as a function of the angular position of the vessel 12 reached in its rotary motion. A liquid pump 10 which can be activated by a motor 11 is provided in the feed pipe duct 13 between its two ends for the purpose of the positive feeding of liquid when connection has been established between the outlet side 17 of the feed pipe 13 and the inlet side of the filling pipe 2. The motor 11 can be a so-called stepper motor, but alternatively it can be a variable-speed electric motor with continuous operation. The feed pipe 13 with its end 17 is always in connection with anyone of the filling pipes 2 and a blockage of the outlet 17 of the feed pipe 13, therefore, never occurs. The inlet end of the feed pipe 13 is located at an appropriate depth, e.g. 5 cm from the bottom of the vessel 12, while its other end 17 terminates in a 'pitch-circle' type opening 18 which during the rotary motion of the vessel 12 is joined successively to the filling pipes 2. The end 17 forms a seal against the upper edge surface of the pipe 2 as the vessel rotates past the pipe. More particularly, the end 17 forms a seal against one or two pipes at a time during the rotation of the vessel 12, and brings about an open connection to the outlet opening of the filling pipe 2 during the time or the angular movement which is required for filling. The end 17 of the feed pipe 13 which is intended to be sealingly joined to the inlet sides of the filling pipe 2 is provided in a preferred embodiment of the invention with sealing surfaces, for example in the form of a horizontally projecting, surface-enlarging lip 9 or a similar arrangement.

In accordance with a preferred embodiment of the invention the openings of the filling pipes 2 opening out into the vessel 12 are all arranged in the same plane constituting an annular plane sliding track 19 against which the lower sealing surfaces 9 of the feed pipes 13 are adapted to slide while forming a seal against the sliding track.

Figure 2:
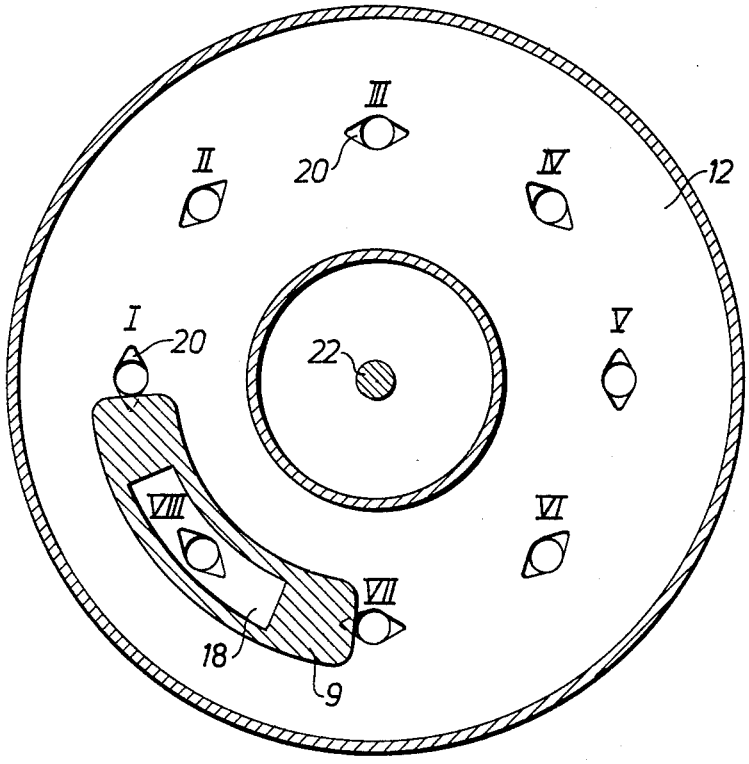
FIG. 2 is a cross-section through the lower part of the feed pipe taken along the section line A—A of FIG. 1, the position of the filling pipe being defined by division into stations or working positions I–VIII.

In accordance with another preferred embodiment the ends of the filling pipes 2 opening into the vessel 12 are provided with a portion 20, enlarged in relation to the cross-sectional area of the filling pipe 2 and extended in the direction of the rotary motion (FIG. 2).

In accordance with a further embodiment the outlet opening 18 of the feed pipe 13 has a considerably larger area than the cross-sectional area of the feed pipe 13 and the said larger outlet area 18 is of an elongated shape and forms part of an opening which, in this case, is circular.

By virtue of the design described above it is made possible for the filling pipes 2 rotating with the vessel 12 to be kept completely filled with liquid, since the top openings of the pipes are always below the liquid surface. During a part of the rotary motion which is taken up by the instant of filling, the pipe mouths 2 are covered by the outlet lip 9 of the feed pipe 13. During this period there is consequently no free communication between the liquid in the vessel 12 and the liquid in the momentarily closed filling pipe 2. Accordingly no air could enter into the system from any direction. As a result froth formation is eliminated in an effective manner at the same time as turbulence is prevented in the system through the relatively slow rate of flow.

As mentioned above each filling tube 2 is provided with an opening and closing valve 14 which, in the position when connection between the filling tube 2 and the feed tube 13 has not been established, rests tightly against the lower portion of the pipe which preferably is designed as a valve seat. In the embodiment described here the valve 14 does not have an actual control function. Rather, the valve 14 should not open before the filling pipe 2 with its upper opening area has entered underneath the sealing lip 9 of the feed pipe 13 and it should shut again before the filling pipe 2 in question has left the sealing lip 9 of the feed pipe. The valve 14 is positively controlled by a cam follower mechanism 4, indicated only schematically on the drawing. This mechanism 4 includes among other things a rod 23, one end of which is fixed to the valve spindle 24 and the other end of which is coupled to a stationary cam for the purpose of movement of the valve spindle 24 so as to control the opening and closing movements of the valve 14.

In certain cases the valve 14 may be designed with a pressure-controlled, spring-loaded spindle or by providing a wire-netting in the lower portion of the pipe 2. As a result, the quantity of liquid metered quite simply will be the amount pumped discontinuously which by virtue of the pump pressure opens the valve. This, in certain cases, can be an advantage.

The filling pipe 2 is surrounded, in accordance with an embodiment of the invention, by a mandrel 1 whose main object is to carry a packing container 25 intended for filling. The packing container may include a shell and a bottom piece and which usually is designated a capsule. The position of the mandrel 1 is maneuvered by a cam mechanism 3 which includes a fixed cam 26 and rolls or similar cam followers co-operating with it. The cam mechanism 3 is adapted so that at the start of the filling process the mandrel 1 is moved relative to the filling pipe 2 so that the end of the pipe 2 projects from the front part of the mandrel 1. The reason for the movement having to be carried out is that the outside of the mandrel must not come into contact with the liquid but should remain dry. The filling process for a filling pipe thus will be as follows:

(a) the relative movement between the mandrel 1 and the filling tube 2 is initiated in that the mandrel 1 is pulled upwards with the help of the cam mechanism 3 at the same time as the capsule 25 is retained in its position which means that the capsule is pulled away a little from the mandrel 1 without the capsule 25 being pulled downwards, (b) the valve 14 is opened and connection between the feed pipe 13 and the capsule 25 is established, (c) the capsule is pulled downwards and is simultaneously filled with liquid, (d) the filling ceases when the capsule is filled (and the connection of the filling pipe 2 with the feed pipe 13 has been broken), while the downwards feed of the capsule continues until it is clear of the filling pipe 2.

As the filler in accordance with the invention is intended for liquids which are liable to attack by microorganisms, it is of the greatest importance that the filler can be cleaned in a simple and effective manner. The cleaning is done in such manner that the cam mechanism 3 is disengaged, and a loose bottom part is inserted into the open end of the mandrel i.e., (no capsule is threaded onto the mandrel 1). The vessel 12 is filled with cleaning agent instead of product, and the machine is then run in normal manner so that cleaning agent from the vessel 12 is pumped down through the filling pipe 2 and is allowed to flow out through the valves 14 and fill out the space between the outside of the filling pipe 2 and the inside of the mandrel 1. Between the inside of the mandrel and the outside of the filling pipe there is also a seal, for example an O-ring 8, which prevents the cleaning liquid from flowing out through the upper part of the mandrel. Instead, a pipe duct 7 is arranged in the mandrel wall, which communicates with the interior of the mandrel 1 and leads to the vessel 12. The cleaning liquid accordingly is pumped through the interior of each filling pipe 2, through the valve 14, along the inside of the mandrel 1 and the outside of the filling pipe 2 to return again to the vessel 12 via the pipe duct 7.

With reference to FIG. 2, a part of the lower portion of the rotating vessel 12 is shown. The specially selected opening area can be determined fairly easily experimentally bearing in mind that the correct filling characteristic should be brought about. In principle the opening from the feed pipe 13 to the filling pipe 2 should always be constant. For the filling pipes 2 the characteristic appropriately should be such that the area, and thereby the flow, successively increase as the upper part of filling pipe 2 is successively exposed and then be constant during the time that the filling pipe 2 is underneath the opening portion 18 of the feed pipe 13. To obtain the optimum filling characteristic, accordingly, the valve 14 should completely open before a connection between feed pipe and filling pipe is established. Consequently the exposed opening area of the filling pipe 2 will be a determining factor for the quantity discharged.

Figure 3:
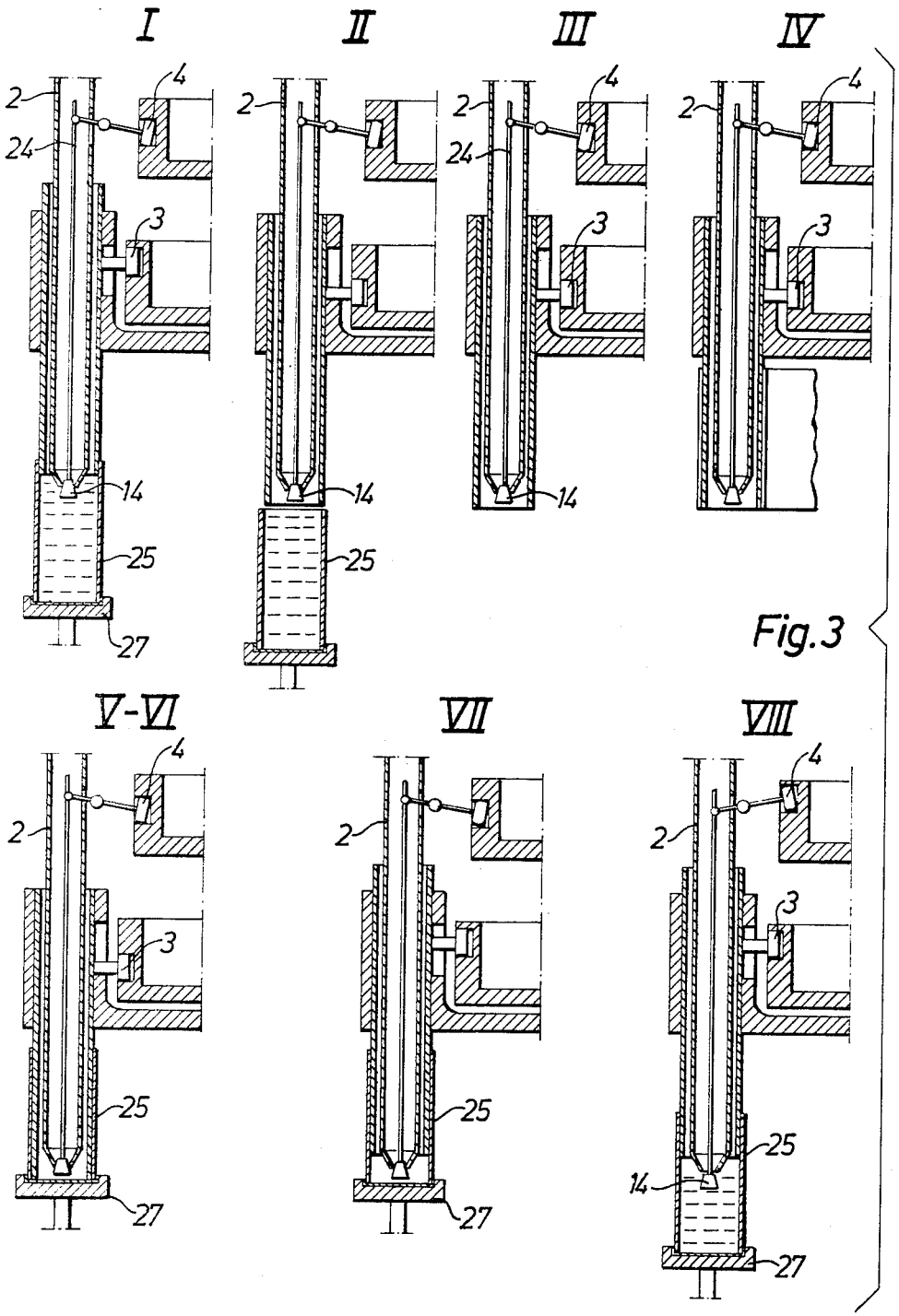
FIG. 3 is a cross-section of the position of the valve device of the filling pipe and the mutual position between filling pipe and package in different working positions.
Figure 4:
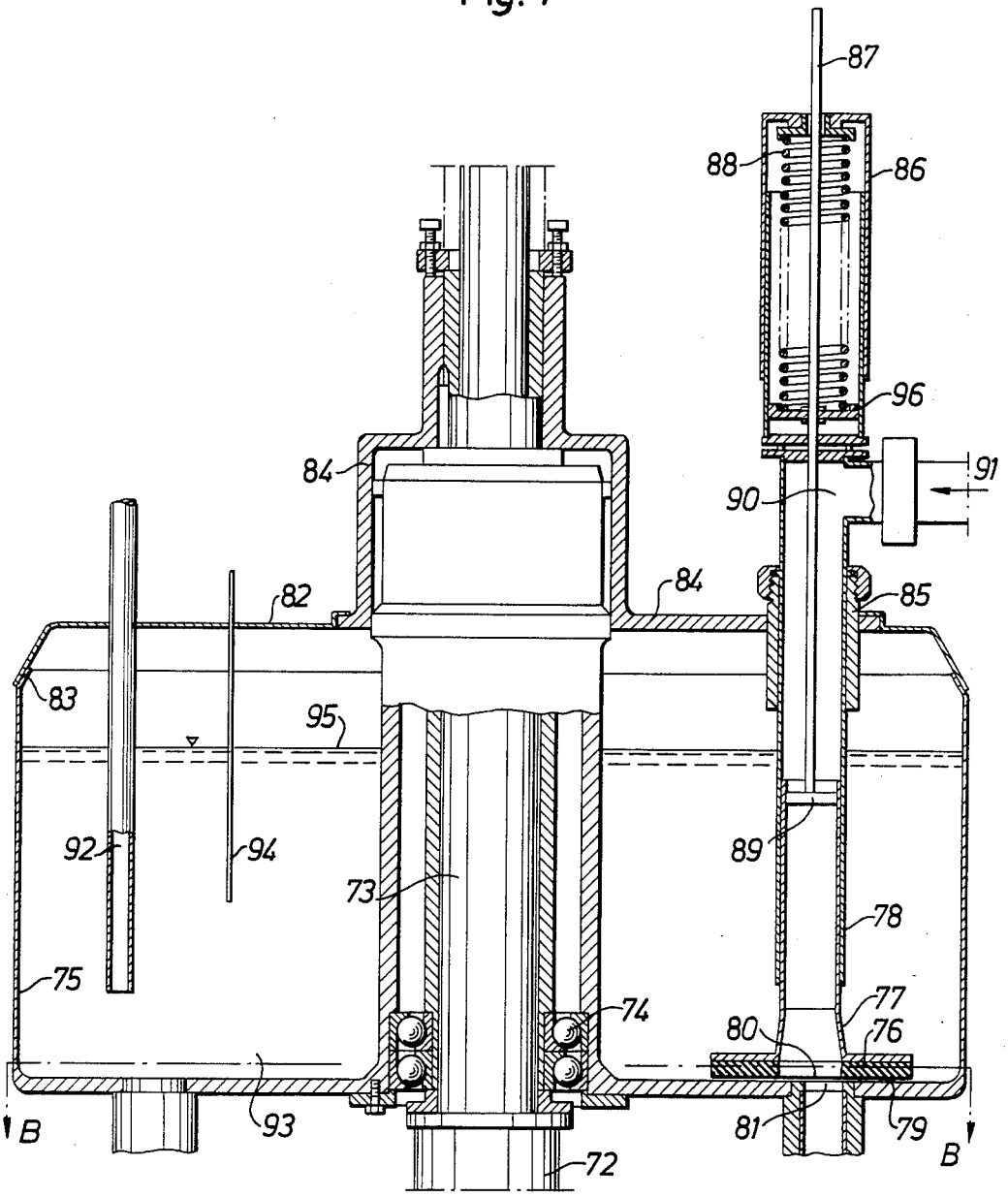
FIG. 4 is a cross-section of the upper part of a filler in accordance with the invention.
Figure 5:
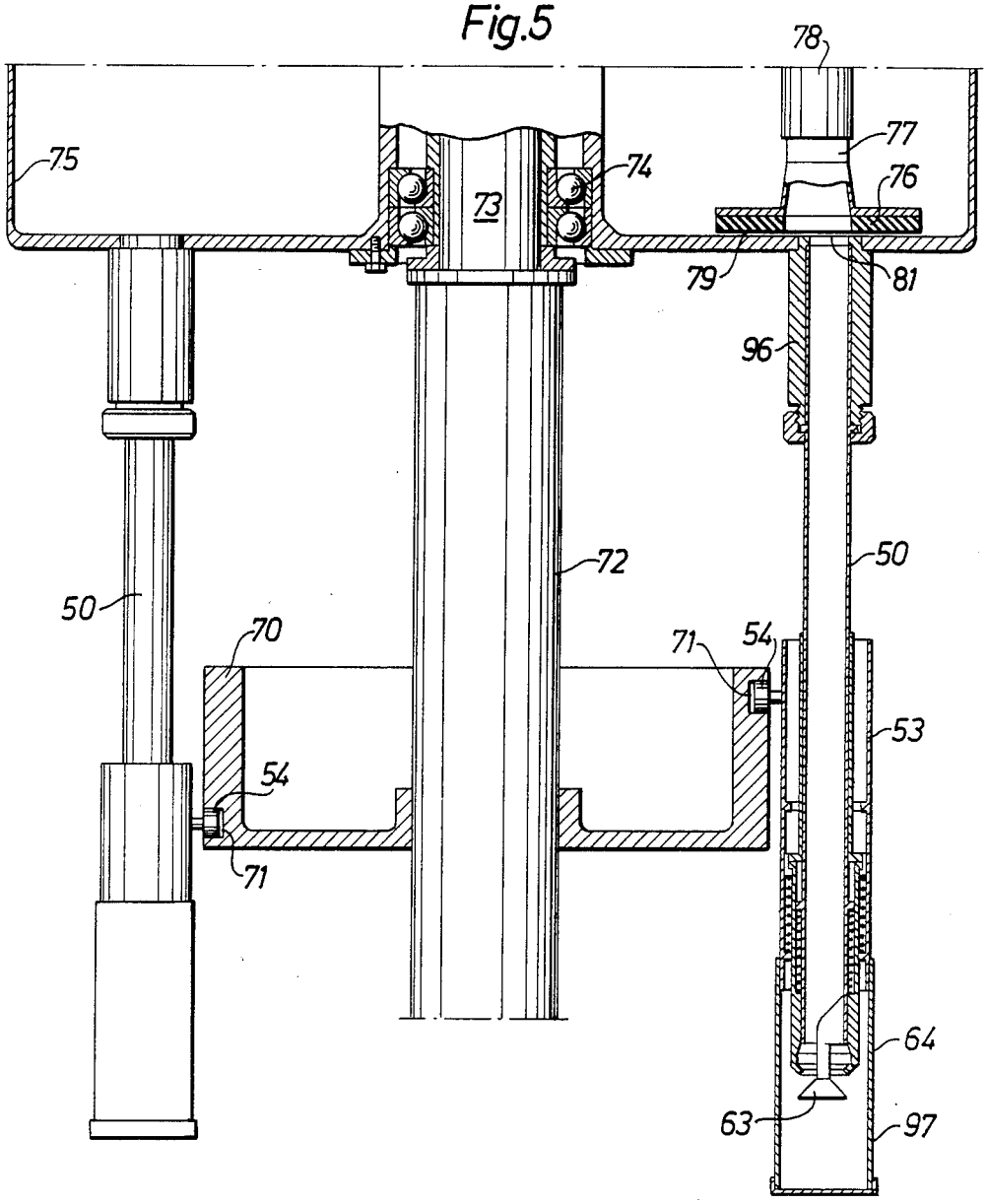
FIG. 5 is a cross-section of the lower part of a filler in accordance with the invention.

In FIG. 3, a filling pipe is shown in different positions or angular positions in relation to the feed pipe 13 and its outlet opening 18. The different valve positions and mutual movements between different elements of the filling device are described briefly in the following with reference to the positions or stations indicated in FIG. 2 which are designated by numerals I–VIII.

Pos. I: A package 25 has just been filled. The valve 14 has been closed (which takes place when the top opening of the filling pipe 2 is under the sealing lip 9 of the feed pipe 13). The bottom-attachment device and holder arrangement 27 of the packing machine is on the way downwards and pulls the capsule 25 off the mandrel 1. The mandrel 1 has just started to move downwards, controlled by the cam mechanism 3.

Pos. II: The filled package 25 has now been pulled off the mandrel 1 completely and may be moved to a lid-attachment station, not shown here. The outlet valve 14 of the filling pipe 2 is closed, of course, and the mandrel 1 is moved in relation to the filling pipe 2 so that the opening valve of the filling pipe 2 is completely retracted into the mandrel 1.

Pos. III: The outlet valve 14 of the filling pipe is closed. The filled package is moved away and the mandrel 1 is ready to receive a new packaging capsule.

Pos. IV: The filling valve 14 and the mandrel 1 are in the same position as in pos. III. A sheet of packing material is wound around the mandrel 1 (possibly a prefabricated tubular blank is pushed onto the mandrel 1) and the edges of the sheet are sealed to one another so that a "tube" is formed around the mandrel.

Pos. V,VI: The filling valve 14 is closed and a bottom-attachment device 27 with a bottom blank provides the shell part manufactured in the previous station IV with a bottom.

Pos. VII: The top part of the filling pipe 2 commences to be introduced underneath the lip 9. The filling valve is closed until the whole of the top opening of the filling pipe 2 is covered by the lip 9, whereupon the filling valve 14 is opened. The mandrel 1 is pulled upwards with the help of the cam mechanism 3 in relation to the stationary filling pipe 2, which means that the capsule 25 present on the mandrel 1 is pulled off a little from the mandrel 1, since the bottom-attachment device 27 which retains the capsule 25 in a positive grip does not move in relation to the filling pipe 2.

Pos. VIII: The filling valve 14 is open and filling takes place as long as the top opening of the filling pipe 2 is in the opening zone 18 of the feed pipe 13. The capsule 25 is pulled off the mandrel 1 in that the device 27 is pulled downwards during the filling operation.

The cycle described here is then repeated in that the filling pipe 2 once more assumes pos. I.

Among the advantages of the filler in accordance with the invention should be mentioned that the whole problem of micro-leakage in the seals practically speaking has been completely eliminated. Should such leakage still occur because of an unsatisfactory fit between feed pipe 13 and filling pipe along the sealing lip 9, only leakage liquid from the feed pipe 13 will pass uncontaminated into the original bulk of liquid in the vessel 12. Moreover, the arrangement is very simple in its design and very inexpensive from a point of view of manufacture as well as of operation. If the filler is combined or completed with automatic weighing of the packing containers at the output, any errors in the metering can be continuously rectified if the pump is driven by a so-called stepper motor. By virtue of suitable electronics, systematic errors between different filling pipes 2 can also be compensated. In accordance with the invention an arrangement has been provided therefore which has eliminated problems met in connection with previously known fillers and which, moreover, has the advantage that it can be used on existing packing machines.

A further embodiment of the filler in accordance with the invention is shown in the FIGS. 4 to 7 inclusive. As is evident from FIGS. 4 and 5 this filler includes a rotary vessel 75 containing a product 93 which is to be packaged. The rotary vessel 75 is supported by bearings 74 on an axle 73 and is given a rotating movement by a driving device not shown here. The rotary vessel 75 is provided at its bottom with a number of downwards directed filling pipes 50 which are fixed to the vessel 75 by tubular holding elements 96. The upper opening 81 of the filling pipes 50 opens into the vessel 75, while the lower part of the filling pipe carries a mandrel 53 and a valve arrangement 63,64 whose function and design will be described in more detail later. The mandrel 53 which is axially movable along the filling pipe 50 is adapted so that it can receive a packing capsule or alternatively constitute a device for the forming of such a capsule.

The filling device is supported by a column 72 on which a circular control device 70 with a cam track 71 is arranged. Followers 54 which are fixed to the mandrels 53 are adapted so as to slide in the cam track 71 and are controlled by the same, so that during the rotary motion of the vessel 75 and the filling pipe 50 the mandrels are axially moved in relation to the filling pipe 50 by the followers 54 being displaced in their position by the cam track 71.

In the filling arrangement described in the previous embodiment it is assumed that the lower lip 9 of the feed pipe 13 forms a seal against the bottom 19 of the vessel 12. Even though this design functions well, some wear will occur in certain cases on the contact surfaces so that complete sealing is not achieved. The embodiment described here has a sliding contact between the lower surface-enlarging plate or shoe 76 of the feed pipe 77, but a space 79 always exists between the base plate 76 of the feed pipe and the bottom of the vessel 75. The region 79 may be characterized as a hydrostatic layer, where the pressure between the bottom of the vessel and the plate 76 together with the pressure in the feed pipe 77 above the outlet area 80 adjust the distance 79 in such a manner that the pressure in the region always remains constant, independently of the angular position of the vessel 75. For this purpose it is necessary to make the feed pipe 77 axially springy and this has been achieved in such a manner that the feed pipe 77 via a yoke 89 is coupled to a rod 87 which by virtue of a plate 96 is acted upon a spring 88 in a spring barrel 86. Owing to the spring barrel being divisible and capable of being lengthened or shortened, the spring force of the spring 88 can be adjusted so that a suitable spring-load transmitted by the rod 87 is obtained.

The product 93 intended for packaging which is present in the vessel 75 is supplied to the vessel through a supply pipe 92 and is filled up to a level 95 which is controlled by a level controller 94, here only indicated, which may be of any suitable type. The product 93 in the vessel 75 may be e.g. milk or juice, and this product is pumped in principle in the manner shown in FIG. 1, by a pump from the vessel 75 and is introduced into the part of the feed pipe 77 shown in FIG. 4 at the point 91 marked with an arrow. The product intended for filling is pumped through the pipe 90 down into the lower part 77 of the feed pipe, at the outlet 80 of which the product either comes into contact with the bottom of the vessel 75 or with the top opening 81 of a filling pipe 50 brought forward on rotation of the vessel 75. In both cases a hydrostatic excess pressure relative to the pressure in the product 93 in the vessel 73 arises in the region 79 and 80 underneath the end plate 76 of the feed pipe 77 and above the outlet area 80. This hydrostatic pressure acts against the spring force of the spring 88 in such a manner that the plate 76 is raised a little if the hydrostatic pressure increases or is lowered somewhat if the hydrostatic pressure diminishes. Certainly a certain "leakage" or transport of product will occur from the lower end of the feed pipe through the gap 79 out into the vessel 75, but this is of no importance since this "leakage" will only reenter into the bulk of the product present in the vessel 75. With the help of the arrangement the spring force of the spring 88 can be adjusted in such a manner that a suitable pressure at the delivery of the product through the filling pipe 50 is obtained. It is possible in principle by virtue of the arrangement to fill at a product pressure kept constant with the help of the spring 88, which had not been possible in the embodiment described earlier where the pressure of the product was wholly determined by the pressure of the feed pump.

On rotation of the vessel 75, as in the embodiment described earlier, the top openings 81 of the filling pipe will successively be conducted past and coincide with the outlet opening 80 of the feed pipe 77. The product 93 which is pumped from the vessel 75 in a pipeline not shown here into the feed pipe 77 at the point 91 marked with an arrow, will be pumped owing to a force provided by a pump inserted in the feed pipe through the filling pipe 50 down into a packing capsule 64 arranged at the lower opening of the filling pipe and provided with a bottom part which is filled with the product. The filling pipe 50 is of course in connection with the vessel 75 through its top opening 81 also during the time when it is not joined to the feed pipe, which means that the filling pipe 50 is filled with product 93. However, since a valve arrangement in the lower part of the filling pipe is closed during this time of the work cycle, no product will flow out through the lower part of the filling pipe 50.

The vessel 75 is closed at the top by a stationary lid 82,84 which via a sealed gap 83 is joined to the upper edge zone of the vessel 75. The stationary parts of the filler, e.g. the supply pipe 92, transmitter 94 of the level controller and the feed pipe 78 are fixed in the lid 82,84.

In the embodiment of the filler described earlier which has a sliding seal between the lower part of the feed pipe and the bottom of the vessel, the filling is performed in such a manner that the product flows through the filling pipe and out into the package during the time that the top part of the filling pipe is connected to the outlet opening of the feed pipe. It is true that the filling pipe is provided with a lower valve, but this valve does not control the filling process itself. Rather, its task is to open as soon as the sealing plate of the feed pipe has covered the top opening of the filling pipe before the outlet opening of the feed pipe to any part overlaps the top opening of the filling pipe and to close again the lower part of the filling pipe before the bottom sealing plate of the feed pipe exposes any part of the top opening of the filling pipe. Thus the function of the valve is only to ensure that the lower part of the filling pipe is open during the part of the cycle when the lower part of the feed pipe to any part overlaps part of the filling pipe and that the lower part of the filling pipe is closed again when the sealing plate of the feed pipe leaves the top opening of the filling pipe.

In the arrangement described here, however, the valve arrangement also has a secondary, "controlling function" of the filling process, since the filling of the package commences as soon as the valve opens and is interrupted when the valve closes again.

The valve arrangement is described in FIGS. 6,7,8 and 9, each of which shows in cross-section one of the filling pipes of the filler and, as mentioned previously, the filler may be provided with any number, e.g. 8, of evenly distributed filling pipes. In the valve arrangement which is shown in FIGS. 6,7,8, and 9 the filling pipe 50 is provided with a valve spindle 65 fixed in the lower part of the filling duct 52 whose outer part is provided with a valve cone 63. The valve cone 63 is adapted so as to form a tight seal against a movable valve seat 64 which constitutes the lower part of a cylindrical body 98 arranged coaxially with the filling pipe 50. The cylindrical body 98 can slide with its inside against the outside of a flange 66 provided on the filling pipe 50 and along the lower part of the filling pipe 50 which is provided with a seal of the O-ring type 99. The cylindrical body 98 also has a shoulder 67, and between the cylindrical body 98 and the outside of the filling pipe 50 a space 60 is formed, within which a helical compression spring is arranged which exerts its spring force between the shoulder 67 of the said cylindrical body 98 and the flange 66 of the filling pipe 50. Accordingly the cylindrical body 98 can be moved upwards along the filling pipe 50 by overcoming the spring force of the compression spring in the space 60, this spring force being relatively low. Around the filling pipe 50, moreover, an outer pipe 51 is fitted which has a lower shoulder or flange 55. This pipe 51 can be made movable but it can be fixed in its position relative to the filling pipe 50. The shoulder or flange 55 constitutes a stop for limiting the upwards directed movement of the outer cylindrical part 98.

The valve arrangement also has a mandrel 53 which is intended to carry a package blank or for a sheet or a web of packing material to be wound around the mandrel 53 so as to form a package body which in the manner described earlier can be provided with a bottom part. In FIGS. 6–9 the packing container arranged on the mandrel is shown by dotted lines and is designated 97. The mandrel 53 is axially displaceable along the filling pipe 50 and the displacement movement is brought about with the help of a cam track 71 and cam followers 54 which run in the cam track 71 to displace the mandrel 53 in axial direction in relation to the filling pipe 50. This displacement is brought about as the vessel together with the filling pipes rotates while the control device 70 which comprises the cam track 71 is stationary. The mandrel 53 has two flanges or shoulders 58 and 61 facing inwards and a separate ring 57 provided with a flange which is arranged so that it can slide along the outside of the cylindrical ring 98. The annular part 57 is also adapted so that it can slide along the inside of the part of the mandrel 53 which is limited by the shoulders or flanges 58 and 61. In the space 59 between the lower part of the annular part 57 and the flange or shoulder 61 of the mandrel a compression spring is provided which endeavours to hold the annular part 57 pressed against the upper shoulder or flange 58 of the mandrel 53. It should be noted, moreover, that the compression spring which is accommodated in the space 59 has an appreciably greater spring force than the compression spring which is contained in the space 60 and that the bottom edge 62 of the mandrel 53 projects beyond the valve cone 63.

Figure 6:
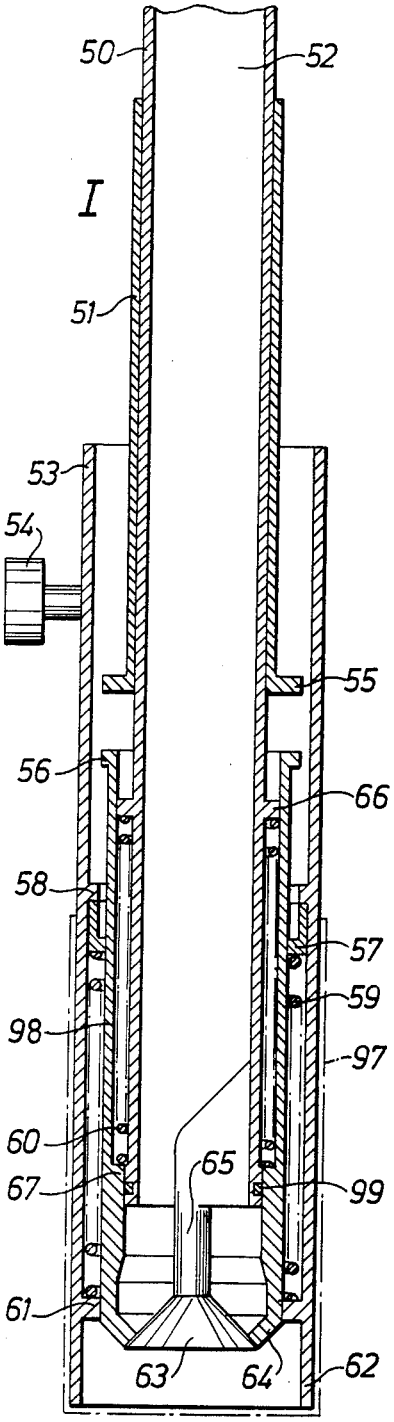
FIGS. 6, 7, 8 and 9 are cross-sections of the valve mechanism of the filling pipe in different working positions.

In FIG. 6 the valve arrangement is shown in its closed position which means that cam follower 54 is in its lower position. In this position of the mandrel and the valve arrangement the packing container 97 is mounted around the mandrel or a packing container 97 is formed around the mandrel. This packing container is held at its bottom part by a holding arrangement, not shown here but schematically described in the earlier embodiment, by which the container formed can be pulled off the mandrel 53 by imparting a downward movement to the container. As mentioned previously, these holders which in the foregoing embodiment are designated 27, must have a synchronous rotary motion with the filling pipe and be adapted so that they retain the packing container pulled off the mandrel 53 in a firm grip after the packing container has been filled and separated from the mandrel.

Figure 7:
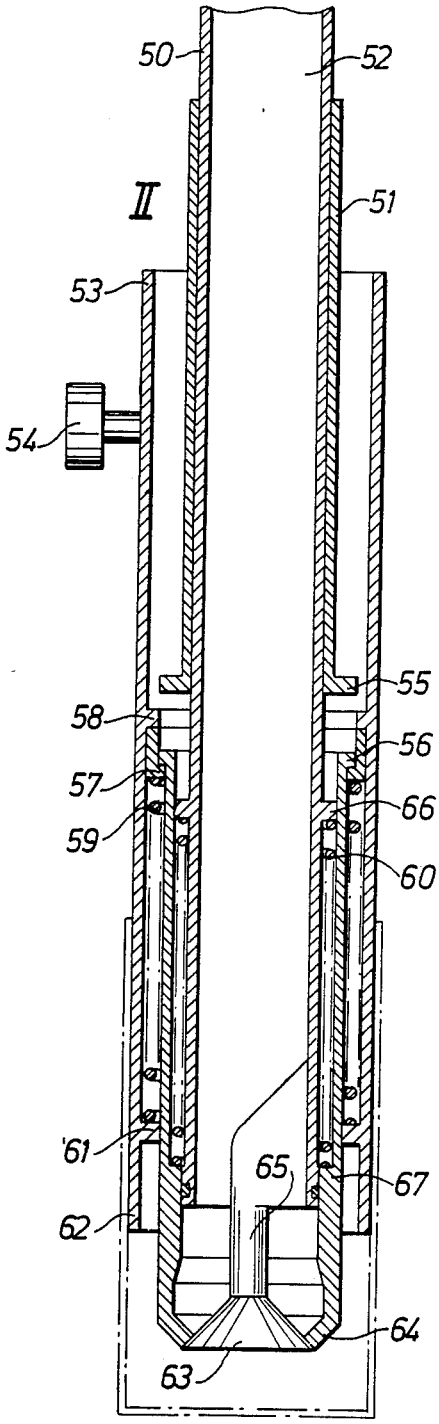

The filling operation is initiated in that the mandrel 53 is moved upwards in relation to the filling pipe 50 by the cam follower 54, the lower shoulder 61 of the mandrel and the annular ring 57 sliding against the outside of the cylinder part 98. This sliding movement constitutes a displacement of the mandrel 53 in relation to the filling pipe 50 without the springs 59 or 60 being compressed, and the displacement continues until the projecting shoulder or flange of the annular ring 57 comes into contact with the upper outwards directed flange or shoulder 56 of the cylindrical part 98. This position is illustrated in FIG. 7, and as can be seen a relative movement also takes place between the mandrel 53 and the packing container 97 arranged on the mandrel. The container 97 is partly pulled away from the mandrel because of the mandrel moving upwards while the packing container 97 is retained in its holding arrangement.

Figure 8:
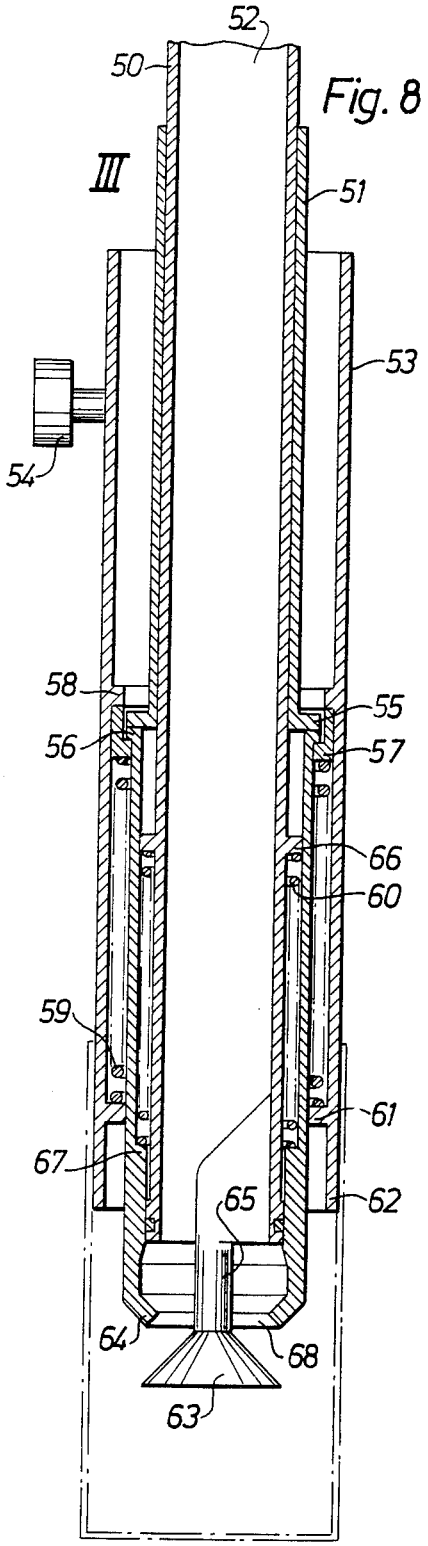

When the filling arrangement has attained the position which is shown in FIG. 7, the filling commences in that the filling valve is opened at the same time as the container 97 with the help of its holding arrangement is pulled downwards. Preferably the pulling down of the packing container 97 should take place at the same rate as the product level in the vessels rises, which means that the product level in the vessel should maintain a constant position in relation to the environment. As can be seen in FIG. 8, the valve is opened in that the cam follower 54 moves further upwards, which happens when the filling pipe 50 has reached such a position under the feed pipe 77 that the filling pipe and the feed pipe partly overlap each other or that at least the plate 76 has entered over the opening 81 of the filling pipe 50.

As the cam follower 54 is guided upwards by means of the cam track 71 the mandrel 53 is raised further in relation to the position shown in FIG. 7. Since the controlling shoulder of the annular ring 57 has made contact with the upper outwards directed flange or controlling shoulder 56 of the cylindrical part 98, the cylindrical part 98 is pulled upwards, since, as mentioned earlier, the spring force of the compression spring in the space 59 is appreciably greater than the spring force of the compression spring in the space 60. When the cylindrical part 98 is pulled upwards under compression of the spring in the space 60 the valve seat 64 will lose touch with the stationary valve cone 63 so that a flow duct 68 is formed between the valve seat 64 and the valve cone 63.

Figure 9:
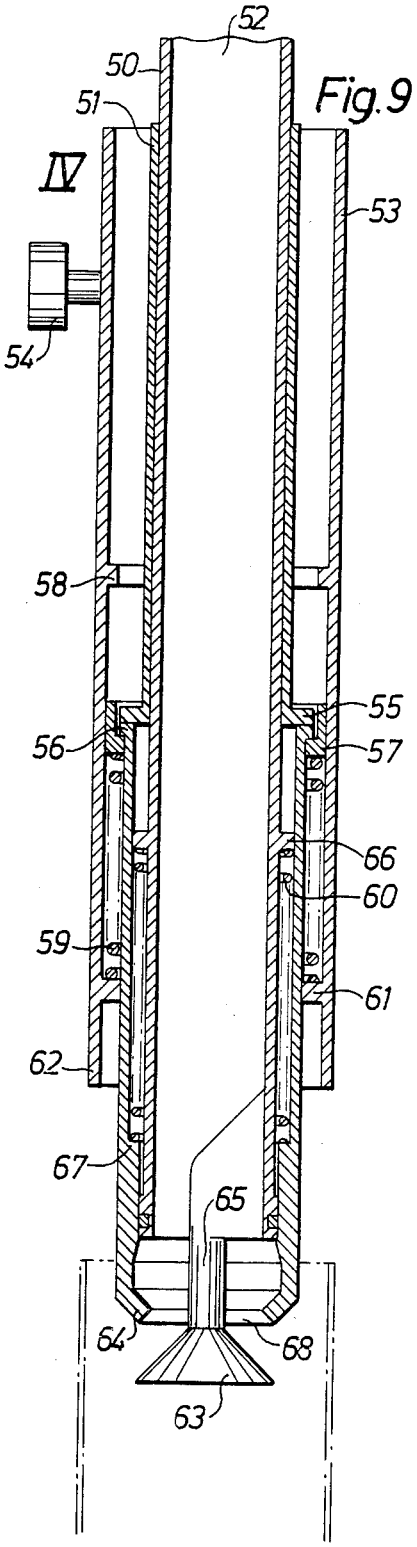
Figure 10:
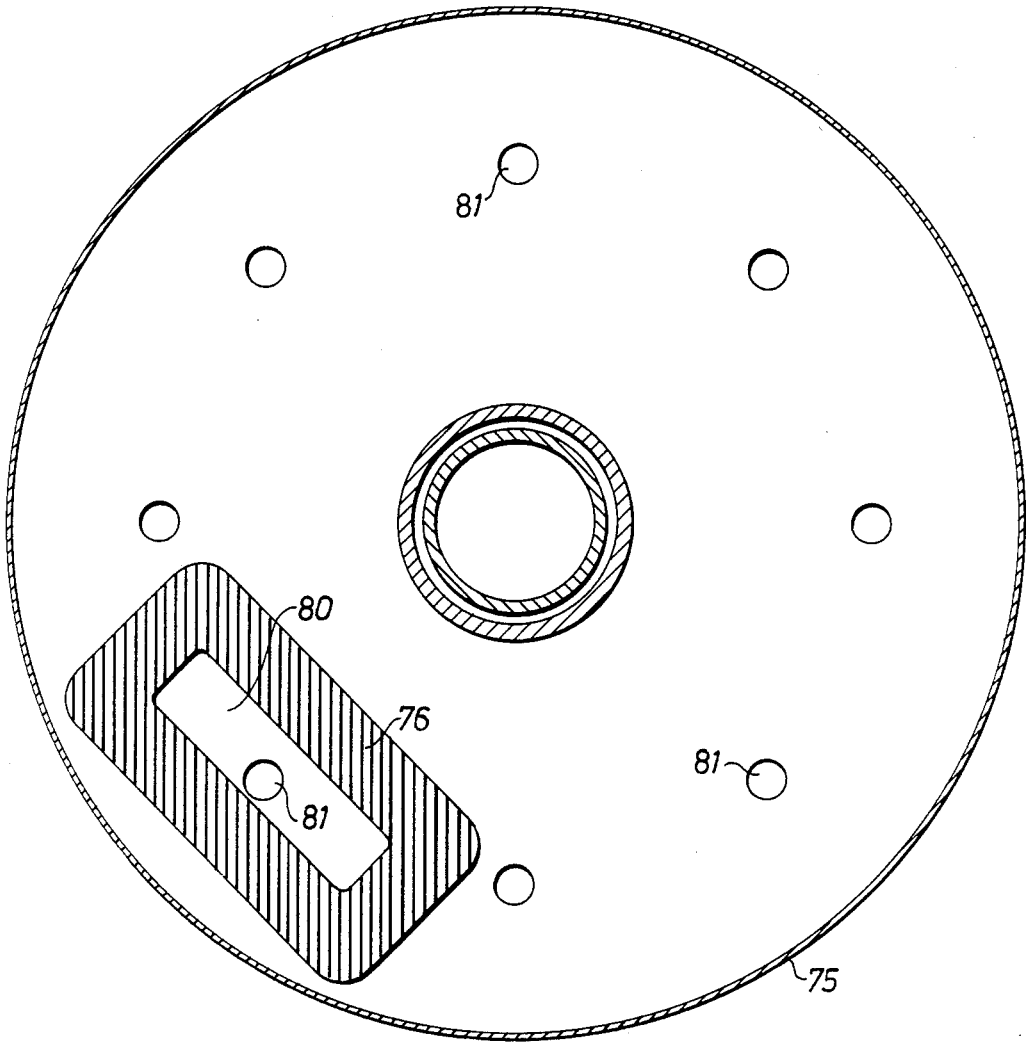
FIG. 10 is a cross-section through the filler taken along the section line B—B of FIG. 4.

Since the interior 52 of the filling pipe 50 is filled with product and the top part 81 of the filling pipe 50 is joined to the feed pipe 77, product will flow through the filling duct 52, through the valve passage 68 and out into the packing container at the same time as the container is pulled off the mandrel 53. Opening of the valve takes place until the position as shown in FIG. 8 has been attained, that is to say the top side of the top flange 56 of the cylindrical part 98 pushes against the underside of the flange 55 on the pipe 51 which has been fixed around the filling pipe 50. When the cylindrical part 98 has reached this position it can not move upwards further, since such movement is prevented by the shoulder or flange. However, the further movement upwards which the mandrel 53 performs under the control of the followers 54 has the effect that the stronger compression spring in the space 59 will be compressed at the same time as the mandrel moves further upwards up to the position as shown in FIG. 9. In the position shown in FIG. 9 the mandrel has completely lost touch with the packing container 97 which is now assumed to be filled, and which is now pulled off to a level below the mouth of the filling valve, to be subsequently carried off in sideways direction.

When the filling has been completed the valve closes in the reverse manner. That is, the mandrel 53 is lowered in relation to the filling pipe with the help of the cam follower 54, the first compression spring in the space 59 is relieved and the mandrel assumes the position as shown in FIG. 8 whereupon the mandrel is lowered further while the valve is closed, as shown in FIG. 7, and thereafter the mandrel 53 is lowered to its lowest rest position as shown in FIG. 6. In this position a new packing capsule is arranged around the mandrel 53, whereupon the cycle is repeated.

In the embodiment given here it has been assumed that the vessel containing the product rotates while the feed pipe is fixed, but in certain types of packing machines, e.g. those where the packing containers are transported along straight, parallel, horizontal conveyor belts it is desirable for the filling pipes to be stationary. A filler which functions according to the above-mentioned principle cannot be used in such cases. In the type of device with stationary filling pipes the filling pipes may be fixed in the manner shown previously in a vessel which is stationary, while the feed pipe 13,77 is adapted to rotate so that its bottom outlet opening 80 and its sealing plate 76 describe a circle, the outlet 80 of the feed pipe 77 successively coming into contact with the top openings of the stationary filling pipes. The filling arrangement is intended accordingly to operate in the same manner as has been described earlier, but with the difference that the relative movements between the vessel 75, with its filling pipes 50 and the feed pipe 77 is obtained here in that the vessel is stationary and the feed pipe is movable. In this case packing containers manufactured in advance can first be fitted around the filling pipe with the help of holding devices and then be lowered down into their conveyor belt during the filling. Thereafter, the containers are transported further, after the filling has stopped, by the conveyor belt removing the filled packages in horizontal direction, while new empty packing containers are introduced in front of the filling pipe.

Sometimes it is desirable that the filler should also be able to operate with one or more filling stations shut off. In the design of the filler as described above this is not readily possible without certain measures first being taken.

In accordance with the invention this problem is solved in that one or more of the valves 63,64 or 65 (FIGS. 6–9) at the lower end of the filling pipes 50 can be kept closed at the same time as other valves operate normally. This can be done without having to act upon the movement of the mandrel 53, and the only thing required is that the outer pipe 51 with the shoulder 55 must be pushed towards the upper shoulder 56 of the cylindrical body 98. If this is done, the valve cannot be opened by the cylindrical body 98 being pulled upwards with the help of spring force from the springs 59 and 60 which in turn are acted upon by the controlled mandrel 53. It should be noted that the movement of the mandrel 53 which is controlled by the cam followers 54 is not influenced, but that an up-and-down controlled movement is imparted all the time to the mandrel by a cam which acts upon the cam followers 54. However this movement is absorbed completely by the springs 59 and 60 in the case when the shoulder 55 of the outer pipe 51 has been pushed down so far that the shoulder 55 makes contact with the shoulder 56 of the tubular body 98 when the valve seat 64 is in closed position.

The adjustment of the position of the outer pipe 51 can be performed in a simple manner, either manually or with the help of a mechanical regulating device. With the position of the shoulder 55 it is possible also to set a maximum opening of the valves 63,64 and in this manner also to adjust the flow through the valves. In other words, by the adjustment of the position of the outer pipe 51 it is possible to set the quantity of liquid discharged from the valves 63,64.

By raising the outer pipe to a higher level than that which it has in normal operation it is possible to allow the tubular body 98 to be lifted to such an extent that the bottom sealing ring 99 is exposed. This is of importance when the arrangement is to be cleaned by washing since it will then only be necessary to raise the position of the shoulder 55 and to run washing agent through the filler. The washing agent will then wash not only the inside of the filling pipe 52, the valve 63 and the valve seat 64, but also will be able to wash the region of the sealing ring 99 which is of great importance.

It has been found that a packing container in accordance with the invention operates simply and reliably at the same time as giving high filling capacity and good filling accuracy. The prerequisites also exist for making the filler aseptic, that is to say capable of being filled with sterile contents without any risk of infection of the contents, through the adoption of relatively simple additional measures.

The principles, preferred embodiments and modes of operation of the present invention have been described in the foregoing specification. The invention which is intended to be protected herein should not, however, be construed as limited to the particular forms disclosed, as these are to be regarded as illustrative rather than restrictive. Variations and changes may be made by those skilled in the art without departing from the spirit of the present invention. Accordingly, the foregoing detailed description should be considered exemplary in nature and not as limiting to the scope and spirit of the invention as set forth in the apended claims.

What is claimed is:

1. A filler for packing machines in which a liquid product is metered into packing containers, comprising:

a rotatable vessel for containing the liquid product which is to be filled into the containers;

a plurality of filling pipes rotatable with the vessel and projecting from a bottom of the vessel and communicating with the vessel;

a stationary feed pipe having two ends, both of which open below the liquid level in the vessel, one outlet end of said feed pipe being adapted to be joined successively for communication with an inlet end of each of the filling pipes as a function of relative movement between the filling pipes rotatable with the vessel and the stationary feed pipe; and a pump arranged between the ends of the feed pipe for feeding liquid from the vessel to the containers when communication has been established between the outlet end of the feed pipe and the inlet end of the filling pipe.

2. The filler in accordance with claim 1, wherein a lower portion of each filling pipe is provided with a valve, the opening and closing of the valve being positively controlled during the period of filling of packing containers.

3. The filler in accordance with claim 1, wherein a lower portion of each filling pipe is provided with a beaker-like capsule surrounding an outlet opening of the fill pipe, the upper edge of said capsule being arranged at a level which is higher than the outlet opening of the filling pipe.

4. The filler in accordance with claim 1, wherein the pump is driven by a stepper motor which can be adapted so that in each filling condition it performs a controlled number of revolutions.

5. The filler in accordance with claim 1, wherein the outlet end of the feed pipe which is intended to be joined with the inlet end of the filling pipe is provided with surface-enlarging shoulders which are adapted so as to form a seal against the bottom of the vessel.

6. The filler in accordance with claim 2, wherein the movement of the valve is controlled by a cam follower mechanism.

7. The filler in accordance with claim 1, wherein the inlet end of each of the filling pipes open into the bottom of the vessel and the inlet ends are arranged in substantially the same plane, said bottom including a sliding track against which a lower shoulder of the feed pipe is arranged to slide thereby forming a seal against the sliding track.

8. The filler in accordance with claim 1, wherein the inlet ends of the filling pipe open into the vessel and the inlet ends are provided with a portion which is enlarged in relation to the cross-sectional area of the filling pipe and extended in the direction of the rotary motion.

9. The filler in accordance with claim 1, wherein the outlet end of the feed pipe has an appreciably greater area than the cross-sectional area of the feed pipe, said greater outlet area having an elongated shape and forming a part of an elongated opening.

10. The filler in accordance with claim 1, wherein a sliding track is arranged on the bottom of the vessel and a gap exists between a lower part of the feed pipe and sliding track, said gap being filled with liquid, a shoulder of the feed pipe being pressed by an adjustable spring force against the sliding track for the purpose of maintaining the desired pressure in the gap between the feed pipe and sliding track.

11. The filler in accordance with claim 1, wherein a valve cone is fixed to a lower part of the filling pipe in such a manner that space for flow is formed between the valve cone and the outlet of the filling pipe, and the filling pipe is surrounded by a mandrel which is axially displaceable in relation to the pipe, said mandrel being adapted so as to receive the packing containers intended for filling, the lower part of said mandrel being arranged so that in one end position of the mandrel the lower part forms a seal against the valve cone, while in another end position the mandrel is moved in relation to the valve cone so that a flow duct is produced.

12. The filler in accordance with claim 11, wherein said mandrel is adapted so that by its movement, the mandrel acts upon an element which is arranged so as to slide around the filling pipe, the front part of said element being provided with a valve seat which is adapted to form a seal against the valve cone, and said element, as a function of the relative position of the mandrel to the filling pipe, is adapted to be moved against the spring force of a compression spring to an upper elevated position in which a flow duct is formed between the valve seat and the valve cone.

13. The filler in accordance with claim 1, wherein the feed pipe includes two parts which are telescopically movable within each other, one of the parts being fixed in a stationary lid arranged over the vessel and terminating at the pump for the supply of product to the feed pipe, the other of said parts of the feed pipe forming a seal against the stationary part of the feed pipe and being movable in an axial direction of the feed pipe.

14. The filler in accordance with claim 13, wherein the movable part of the feed pipe is controlled by a compression spring which presses the part of the feed pipe against the bottom of the vessel.

15. The filler in accordance with claim 13, wherein the movable part of the feed pipe is controlled by a compression spring which presses the movable part of the feed pipe against a film of liquid on the bottom of the vessel.

16. The filler in accordance with claim 1, wherein the pump is driven by a motor which operates continuously.

* * * * *